US005163861A

United States Patent [19]

Van Ruymbeke

[11] Patent Number: 5,163,861

[45] Date of Patent: Nov. 17, 1992

[54] WING-OPERATED FLYING TOY, AND A PROCESS FOR AUTOMATICALLY LOCKING THE WINGS, AT THE END OF A FLIGHT

[76] Inventor: Gérard Van Ruymbeke, 30, boulevard Chancel, 13008 Marseille, France

[21] Appl. No.: 688,533

[22] PCT Filed: Dec. 19, 1989

[86] PCT No.: PCT/FR89/00663

§ 371 Date: Jun. 12, 1991

§ 102(e) Date: Jun. 12, 1991

[87] PCT Pub. No.: WO90/06794

PCT Pub. Date: Jun. 28, 1990

[30] Foreign Application Priority Data

Dec. 20, 1988 [FR] France ..... 88 17547

[51] Int. Cl.[5] ..... A63H 27/00; A63H 29/24; B64C 33/00

[52] U.S. Cl. ..... 446/35; 446/59; 446/461; 244/11; 244/22

[58] Field of Search ..... 446/35, 34, 55, 57, 446/59, 10, 461, 463; 244/11, 22, 72

[56] References Cited

U.S. PATENT DOCUMENTS

| | | | |
|---|---|---|---|
| 2,457,281 | 12/1948 | Shannon | 446/57 |
| 2,763,348 | 9/1956 | Corbitt et al. | 446/55 X |
| 3,626,555 | 12/1971 | Albertini et al. | 446/35 |
| 4,318,455 | 3/1982 | Lapierre | 446/59 X |
| 4,591,346 | 5/1986 | Ikeda | 446/461 X |
| 4,729,748 | 3/1988 | Van Ruymbeke | 446/35 |
| 4,850,931 | 7/1989 | Auer | 446/437 |

FOREIGN PATENT DOCUMENTS

| | | | |
|---|---|---|---|
| 1958011 | 7/1970 | Fed. Rep. of Germany . | |
| 2755786 | 6/1971 | Fed. Rep. of Germany . | |
| 2411148 | 9/1975 | Fed. Rep. of Germany | 446/57 |
| 1604345 | 11/1971 | France . | |
| 2580944 | 10/1986 | France | 446/230 |
| 1564900 | 4/1976 | United Kingdom . | |

OTHER PUBLICATIONS

English Abstract of Germany Patent No. 2,755,786.
International Search Report and Annex.
International Preliminary Examination Report.

*Primary Examiner*—David N. Muir
*Attorney, Agent, or Firm*—Sandler, Greenblum & Bernstein

[57] ABSTRACT

Process and apparatus providing the automatic locking of the wings of a wing-operated flying toy, wherein a locking device associated with the operating mechanism is applied, under the effect of elastic pressure, against a notch or slot of the circular disk of the draw crank of the operating mechanism, so that when an elastic band attains its normal power under the effect of torsional moment, the locking device is unable to engage or hold its position in the notch or slot; whereas when the power has almost attained its lowest value at the moment when the elastic band is almost completely untwisted, the locking device is able to engage and maintain itself in the slit causing the wing operating mechanism to lock and prevent movement of the wings.

25 Claims, 3 Drawing Sheets

Fig- 4
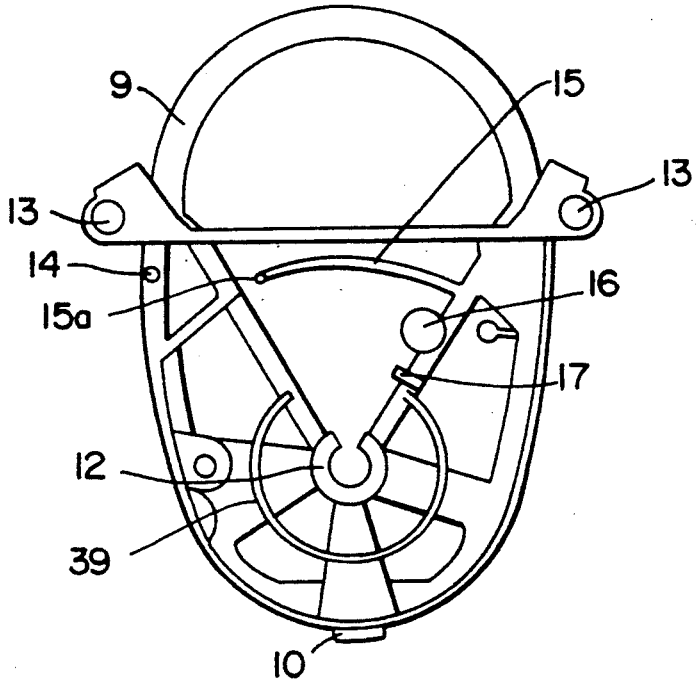
Fig- 5
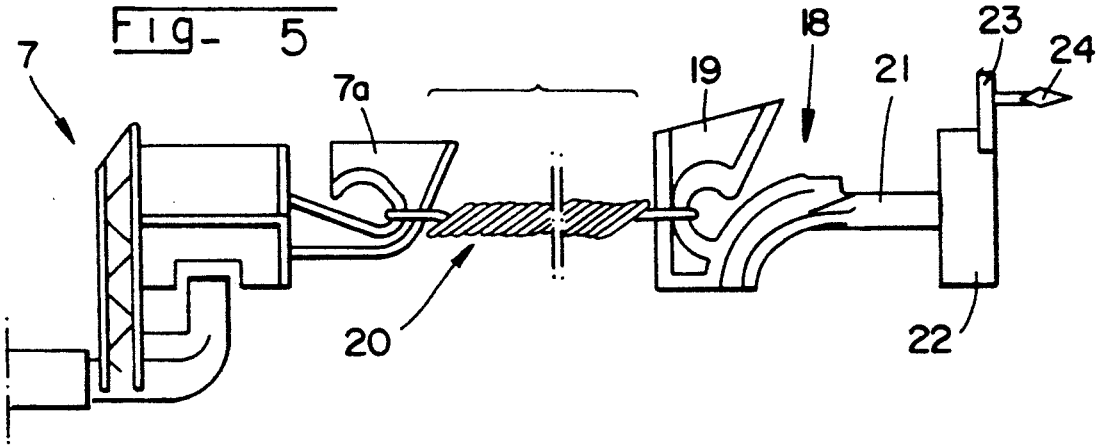
Fig- 6
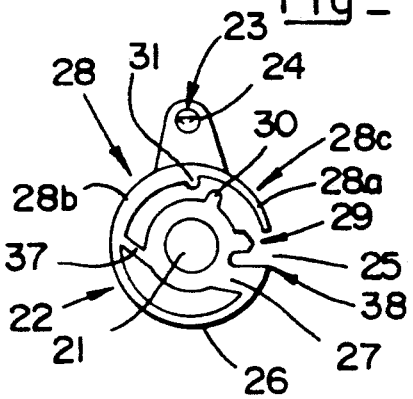
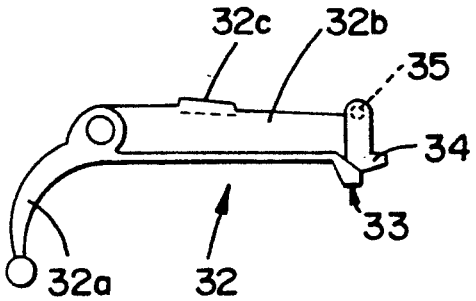
Fig- 7

WING-OPERATED FLYING TOY, AND A PROCESS FOR AUTOMATICALLY LOCKING THE WINGS, AT THE END OF A FLIGHT

BACKGROUND OF THE INVENTION

1. Field of the Invention

The present invention relates to a flying toy able to fly by flapping its wings, while imitating the flight of a bird, with the toy preferably having the appearance of a bird. It also relates to a process for automatically locking the wing activation mechanism at the end of a flight.

2. Discussion of Background Material

A flying toy of this type is described in French Patent 1,604,345 and includes:—a hollow body having an elongated shape made in two parts which are assembled by nesting. In the front part of the body, an activation mechanism for the wings is provided. This wing activation mechanism is driven by means of an elastic band which provides motive power to the toy;—two flexible wings are affixed on the one hand, to the activation mechanism, and, on the other hand, to said body;—a winding system making it possible to twist the motive rubber band is installed on the rear part of said body which also supports a steerable tail wing unit which acts as a rudder; a locking device or stop member is provided, making it possible to neutralize the wing activation mechanism during its winding and prior to takeoff.

The wing activation mechanism is installed in the body, at the level of the nesting, and this mechanism comprises two oscillating levers or wing supports extending through two lateral slots provided on said body in front of said nesting. These oscillating levers or wing supports are connected or adapted to be connected to a wing girder to which is affixed the front edge of the flexible flying surface constituting the wings of the flying toy.

According to current embodiments of flying toys of the above-mentioned type, the flapping of wings ensuring the lift of the flying toy cease when the motive elastic band is completely relaxed. The rhythm of the wing flapping decreasing with the torque of the motive elastic band, it so happens that these flappings cease due to the complete relaxation of the latter, when the toy is at a short distance from the ground, or about to land, enabling the toy to land smoothly. However, it also frequently happens that the wing flapping ceases because of the complete relaxation of the motive elastic band while the toy is still at a significant distance from the ground. If at this moment the wings are not immobilized in a position enabling the toy to glide, the toy "nose-dives" and falls abruptly to the ground, which can more or less damage the toy. In addition, this type of toy has a limitation due to the requirement to manually position the stop member which locks the wing activation mechanism, before proceeding to rewind the wings. Often, users, who are very frequently young children, do not remember to execute this operation.

The invention particularly provides for overcoming these disadvantages.

According to the invention, this goal is achieved by virtue of a process and a device according to which the stop member is applied, under elastic pressure, against a notch provided in the periphery of the circular plate of the drive crank of the wing activation mechanism. Thus, when the motive elastic band develops its normal power level resulting from torque of the motive elastic band, the stop member cannot engage and hold itself in this notch, whereas, when this power level approaches its lowest value, nearing the complete untwisting of said elastic band, the stop member can engage and hold itself in said notch, by causing the wing activation mechanism to stop and the immobilization thereof; the locations of the active part of stop member and of the notch, in the kinematic chain of said mechanism, preferably are predetermined such that the engaging position of said stop member and said slot correspond to the position of the wings enabling the toy to glide.

According to another very significant characteristic arrangement of the process and device according to the invention, the torque resulting from the energy released by the unwinding of the motive elastic band and from the resistance opposed by the wing flapping mechanism causes the deformation of a flexible portion of the cylindrical wall of the plate of the drive crank and the narrowing of a variable width notch or slit provided in the cylindrical wall. This narrowing prevents the engagement, in this slit, of the tooth constituting the active part of the stop member that an elastic element tends to permanently push against the periphery of the plate, until the value of the torque decreases and approaches the complete relaxation of the elastic. This permits said plate to resume its rest form and increases the width of said slot in which the tooth of the stop member can then engage and hold itself while causing the wing to stop flapping.

By virtue of the process and the device according to the invention, the flying toy always terminates its flights in a glide, which makes it possible to land smoothly Furthermore, at the end of the flight, the wing activation mechanism is always locked by the stop member and it is thus not necessary to manipulate this stop member before proceeding to rewind the drive system of said mechanism by the rotation of the crank positioned on the rear part of the body of the toy.

BRIEF DESCRIPTION OF THE DRAWING

The aims, characteristics and advantages mentioned above, as well as others, will become apparent from the description and annexed drawings that follow, in which:

FIG. 4 is a front view of the fixed structure of the wing activation and immobilization device.

FIG. 5 is a side view of the system providing the motive force to the wing activation mechanism, and showing particularly the drive crank of this mechanism.

FIG. 6 is a front view of this crank embodied according to the invention.

FIG. 7 is a front view of the stop member.

DETAILED DESCRIPTION OF THE PREFERRED EMBODIMENTS

The drawings will be referred to in order to describe a preferred embodiment of the device and an implementation of the process according to the invention.

Figure 1:
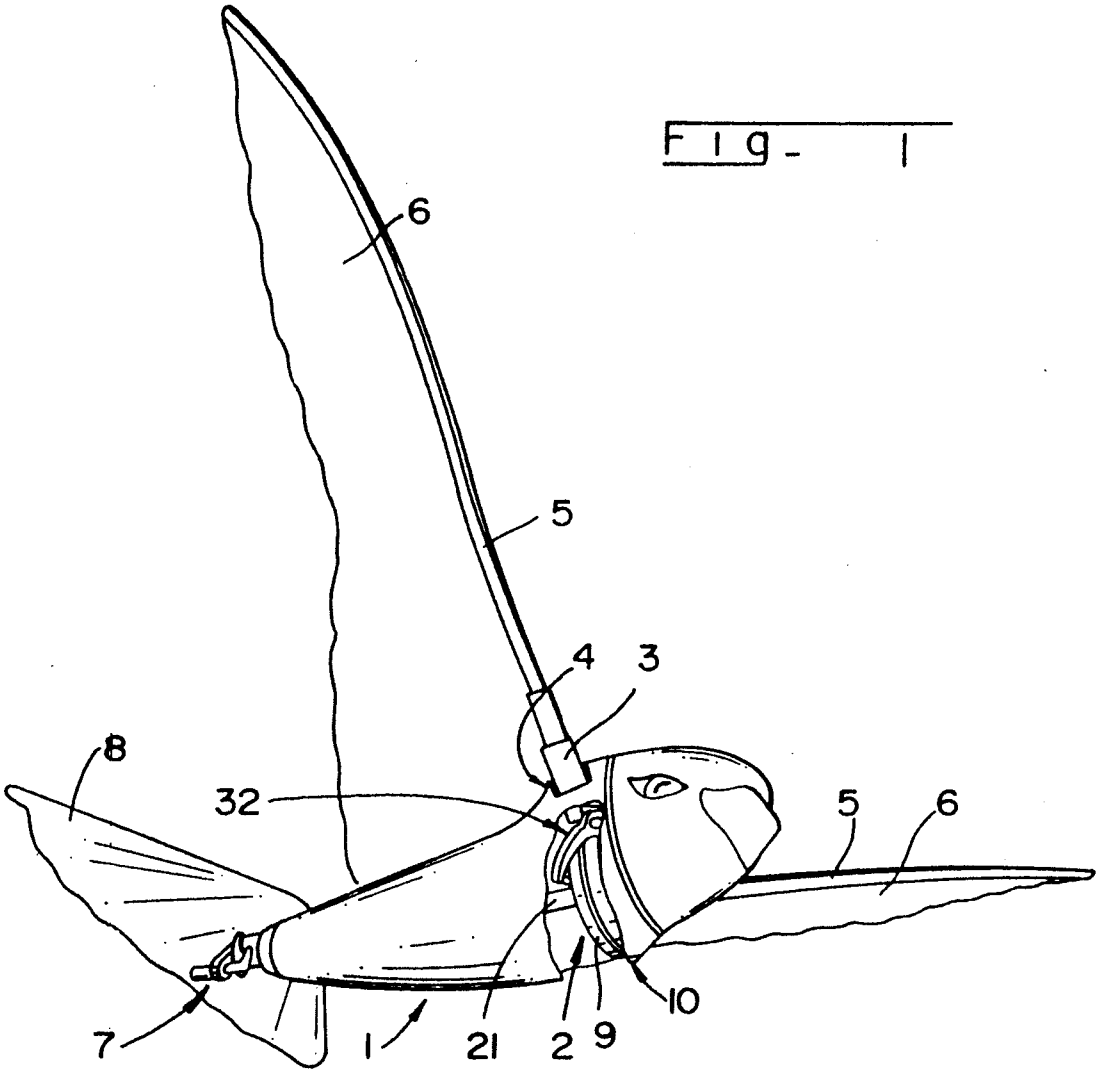
FIG. 1 is a perspective view, with partial cutaway, of a flying toy which can preferably be equipped with a wing activation and immobilization device according to the present invention.

The flying toy of the invention comprises a hollow body 1 having an elongated shape, made in two parts assembled by nesting, the body being generally made of plastic material. In the front part of the body, a wing activation mechanism is provided, which is designated by reference numeral 2 in FIG. 1, and is driven by means of an elastic band, which provides the motive force. This mechanism makes it possible to transmit identical oscillations to the wing supports 3 extending through lateral slots 4 provided in body 1 and whose external parts are connected or able to be connected, for example by nesting, to the girders or spars 5 of the wings. The front edges of the main flying surfaces 6 constituting the flexible wings of the toy are attached to the spars 5, and the rear edge of the main flying surfaces 6 is fastened to the body by hooking onto a lug, by gluing or otherwise A winding system 7, making it possible to twist the motive elastic band, is installed on the rear part of body 1 which further supports a steerable tail wing 8 acting as a rudder.

The wing activation mechanism 2 is installed in the rear portion of the front part of body 1, and includes a rigid annular frame 9 having a transverse shape matching the shape of the rear portion. This frame (FIG. 4) is equipped, on its periphery, with at least one lug 10 lodged in a cutout 11 provided in body 1, so as to ensure the immobilization of the frame within the body.

The fixed frame 9 which is rigidified by reinforcements, is formed of a single piece with:

- a split bearing 12 of the drive crank, positioned in its lower part;
- axes 13 of the oscillating wing supports 3, positioned symmetrically in the upper part of the frame with respect to the vertical plane of symmetry;
- an axis 14 for the pivoting stop member, positioned near one of the axes 13 of the wing supports;
- a spring 15, provided with a support head **15*a*** which tends to hold the pivoting stop member pressed against the rotary plate of the drive crank described hereinafter;
- abutments 16 and 17 which limit the pivoting amplitude of the stop member, in both directions;
- a circular covering 39, positioned around and concentric with the bearing 12.

The drive crank or front crank 18 (FIGS. 5 and 6) mainly includes:

- a rear end 19 shaped like a hook to which one of the ends of the elastic band 20 providing the motive energy is affixed. The other end of the band 20 is affixed to the hook **7*a* of the crank of the winding system 7 installed in the rear end of the body 1** of the toy;
- a shaft 21 mounted rotationally in fixed bearing 12; a circular crank plate 22 provided with a crank pin 23 ending in a hook 24.

The crank plate 22 is constituted by a cylinder of short length, having a smooth exterior surface and in the periphery of which a slot 25 of variable width is provided, and dividing the cylinder into two parts:

- a first flexible part 26 connected to shaft 21, by a rigid rib 27, and by a flexible hinge 37 which is much thinner than the rigid rib; the said flexible part 26 thus constitutes a spring;
- and a second part 28 which is movable and attached to the flexible part 26 at one of its ends and whose other end **28*a*, demarcates the slot 25** for which it forms the movable edge.

The flexible and movable parts 26 and 28 have approximately equal lengths and the crank pin 23 of the crank 18 is affixed to the movable part 28.

In a preferred embodiment, the movable part 28 is itself composed of two parts:

- a rigid part **28*b* attached to spring 26 at one end, while the other end supports the crank pin 23**;
- a flexible part **28*c* positioned behind the rigid part and whose free end 28*a* constitutes the movable edge of the slit 25**.

The end of shaft 21 is provided:

- with a ramp 29 positioned within the space demarcated by the cylindrical wall of plate 22, and near the free end of the movable part 28 thereof, so as to guide this free end in the direction of the fixed edge 38 of slot 25; and
- with a radial projection 30, adapted to cooperate on a projection 31, provided with the movable part 28 of the cylindrical plate, so as to limit the displacement of the latter in the direction of the fixed edge of the slit.

The crank plate 22 is mounted for rotation in the fixed covering 39 constituted by a split cylinder, which resists the rotation of the deformable crank plate 22 in the direction contrary to that of its functional movement, thus forming a braking drum.

The stop member 32 comprises a rocking lever mounted to be pivotal about an axis 14, via its intermediate portion, and comprises:

- an external part or manipulation lever **32*a* extending through one of the two lateral slots 4 provided in the body 1 for the passage of the oscillating wing supports 3**;
- and an internal part or locking latch **32*b* whose free end is equipped with a tooth 33 and against whose upper edge 32*c* the spring 15 rests by means of its support head 15*a*. This tends to permanently push the tooth 33 against the periphery of the cylindrical crank plate 22**.

In the neutral or near the neutral position of the drive crank 18 (where the elastic band 20 has been expended substantially all of its stored motive force), the slit 25 has a width greater than that of the tooth 33 of the stop member 32, such that, in this situation, the latter can engage in the slit 25. Conversely, the tooth 33 of stop member 32 has a width greater than the minimum width of slit 25 when the flexible part 26 is bent, and when the free end **28*a* of the movable part 28 occupies a position close to the fixed edge 38 of the slit 25. In this situation, the tooth 33 cannot engage and hold itself in the slit 3**.

The free end of the internal part **32*b* is equipped with lugs 34 and 35 adapted to rest against the abutments 16 and 17 which limit the pivoting amplitude of the stop member 32** in both directions.

The wing activation mechanism further includes two transmission rods 36 journalled by means of one of their ends, on the crank pin 23 of the drive crank 18, and by means of their opposite ends, on the internal end of the oscillating wing supports 3 mounted so as to be able to pivot in opposite directions, on the axes 13 of the fixed frame 9 of the mechanism.

Figure 2:
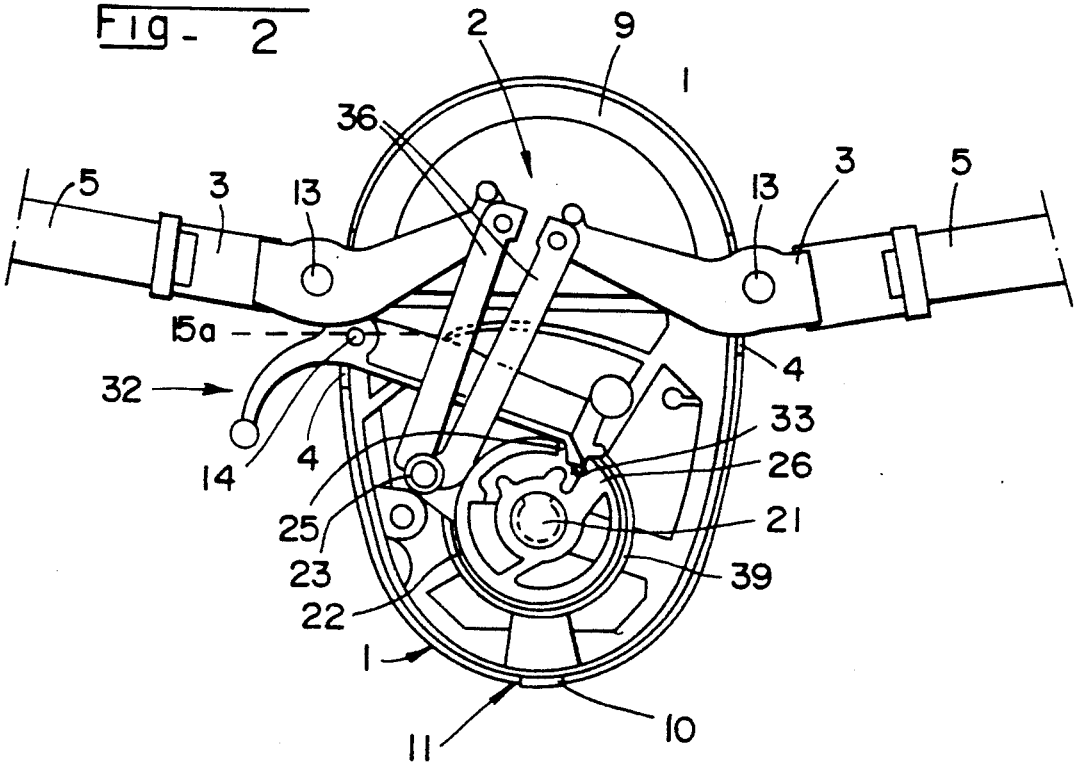
FIG. 2 is a front view of the wing activation and immobilization device shown in the locking position

The wing activation mechanism just described is arranged, according to the invention, so that when the tooth 33 of the stop member 32 engages notch 25, the external part of the wing supports and consequently, the wing girders 5 engaged with the latter, occupy a position in which they form an angle of low amplitude above the horizontal (of about 10 degrees), this position (FIG. 2) enabling gliding.

The operation of the device and the implementation of the process according to the invention can be easily understood.

At the time of takeoff, the tooth 33 of the stop member 32 is engaged, under the pressure of spring 15, in the variable width notch or slit 25 of plate 22 of the drive crank 18. The wing activation mechanism is locked and it is therefore possible to twist the motive elastic band 20 by means of the winding system crank 7, so as to store the energy necessary for flight.

The wing activation mechanism is then unlocked by rocking the stop member 32 by means of the manipulation lever 32*a*, so as to remove the tooth 33 from slit 25, and the toy can then be released The drive crank 18 is then rotated by the motive elastic band 20 which tends to resume its original form, thus ensuring, by means of rods 36 and wing supports 3, the flapping of wings 6—6.

Figure 3:
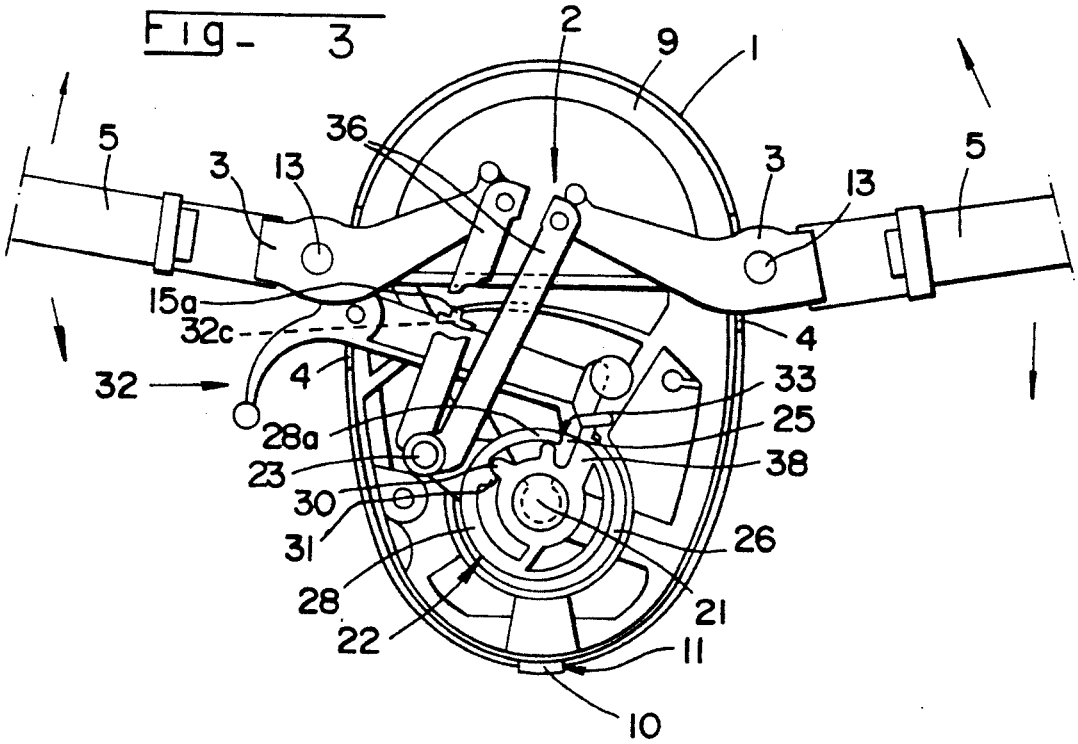
FIG. 3 is a front view showing the wing activation and immobilization device in a dynamic situation.

According to the invention, the resistance opposed by the movement of the wings to the power developed by the motive elastic band generates a torque which leads to a deformation of the flexible part 26 of crank plate 22, such that the movable part 28 of the crank plate rocks around the hinge 37, and that the flexible portion 28*c* of the movable part 28 slides on the ramp 29, and that its free end 28*a* approaches the fixed opposite edge 38 of the slit 25 whose width is then narrowed Because of this narrowing, the tooth 33 of the stop member 32 pushed by the spring 15 against the periphery of the crank plate, cannot engage in the slit 25 of the latter (FIG. 3).

Conversely, when the value of the torque decreases, nearing the complete relaxation of the motive elastic band, the movable part 28 resumes its initial position, under the action of spring 26, such that the width of the slit 25 increases and the tooth 33 of the stop member can engage and hold itself in the slit, while causing the wing flapping to stop and by immobilizing the wings in a spread-out position, thus enabling a gliding flight (FIG. 2) and ensuring a smooth landing of the toy. Furthermore, at the end of the flight, the wing activation mechanism is locked, such that it is possible to immediately proceed to rewind the motive system without requiring a manual manipulation of the stop member.

I claim:

1. A flying toy capable of movement by wing flapping, comprising:

a hollow body having an elongated shape;

a wing activation mechanism positioned at a front part of said hollow body including an elastic band providing motive force;

flexible wings affixed to said wing activation mechanism;

a winding system for twisting said elastic band, which winding system is installed on a rear portion of said hollow body;

a steerable tail wing section installed on said rear portion of said hollow body acting as a rudder;

means for locking said wing activation mechanism during winding of said elastic band, and during flying of the toy upon expending of motive force in said elastic band.

2. The flying toy according to claim 1, wherein said means for locking comprise a lever having a tooth, and a spring for forcing said tooth against a rotatable, circular plate having a variable slit on its periphery.

3. The flying toy according to claim 2, wherein said rotatable, circular plate comprises a split cylinder including a flexible part and a movable part, said movable part is attached to said flexible part at one end and includes a second, movable end forming a edge of said variable slit.

4. The flying toy according to claim 1, wherein said means for locking are constructed and arranged so that, in an engaged position, said wings are positioned in a gliding orientation.

5. The flying toy according to claim 2, wherein, in an engaged position when said tooth is engaged in said variable slit, said wings are positioned in a gliding orientation.

6. The flying toy according to claim 3, wherein said rotatable, circular plate is attached to said drive crank, and said drive crank includes a shaft.

7. The flying toy according to claim 6, wherein said rotatable, circular plate includes a crank pin, and said flexible part supports said crank pin; and said activation mechanism includes transmission rods for said wings, which transmission rods are journalled to said crank pin.

8. The flying toy according to claim 7, wherein said flexible part of said circular plate is attached to said shaft by a rib forming a fixed edge of said slit and by a flexible hinge, whereby said flexible part acts as a spring; and said movable part of said circular plate includes a rigid portion attached to said flexible part and supporting said crank pin, and a flexible portion having said second, movable end forming said edge of said slit.

9. The flying toy according to claim 2, wherein said wing activation mechanism includes a fixed frame; a circular covering comprising a split cylinder rigidly affixed to said fixed frame; and said rotatable, circular plate being rotatably mounted within said split cylinder.

10. The flying toy according to claim 3, wherein a fixed ramp is positioned within a space formed by said periphery of said rotatable, circular plate and said second, movable end, and said second, movable end is capable of sliding on said fixed ramp.

11. The flying toy according to claim 9, wherein said fixed frame includes abutments limiting pivoting amplitude of said lever in each direction.

12. A flying toy capable of movement by wing flapping, comprising:

a hollow body having an elongated shape;

a wing activation mechanism positioned at a front part of said hollow body including an elastic band providing motive force, and a drive crank;

flexible wings affixed to said activation mechanism and said hollow body;

a winding system for twisting said elastic band, which winding system is installed on a rear portion of said hollow body;

a steerable tail wing section installed on said rear portion of said hollow body acting as a rudder;

means for locking said wing activation mechanism during winding of said elastic band prior to flying of the toy, said means for locking comprising a circular plate having a periphery including a slit on said drive crank, and a stop member subject to an elastic force tending to press an active element of said stop member against said periphery of said circular plate.

13. The flying toy according to claim 12, wherein said drive crank includes a shaft, and said circular plate comprises a split cylinder including a flexible part connected to said shaft, and a movable part attached to said flexible part at one end and having a second, movable end forming a edge of said slit, whereby said slit is of variable width.

14. The flying toy according to claim 13, wherein said drive crank includes a crank pin, and said flexible part supports said crank pin; and said activation mechanism includes transmission rods for said wings, which transmission rods are journalled to said crank pin.

15. The flying toy according to claim 12, wherein said active element of said stop member and said slit are constructed and arranged so that, in an engaged position wherein said active element is engaged in said slit, said wings are positioned in a gliding orientation.

16. The flying toy according to claim 13, wherein said flexible part of said circular plate is attached to said shaft by a rib forming a fixed edge of said slit and by a flexible hinge, whereby said flexible part acts as a spring; and said movable part of said circular plate includes a rigid portion attached to said flexible part and supporting a crank pin, and a flexible portion having said second, movable end forming said edge of said slit.

17. The flying toy according to claim 14, wherein said flexible part of said circular plate is attached to said shaft by a rib forming a fixed edge of said slit and by a flexible hinge, whereby said flexible part acts as a spring; and said movable part of said circular plate includes a rigid portion attached to said flexible part and supporting said crank pin, and a flexible portion having said second, movable end forming said edge of said slit.

18. The flying toy according to claim 12, wherein said wing activation mechanism includes a fixed frame; a circular covering comprising a split cylinder rigidly affixed to said fixed frame; and said circular plate being rotatably mounted within said split cylinder.

19. The flying toy according to claim 12, wherein said wing activation mechanism includes a fixed frame; and said stop element comprises a lever pivotally mounted to said fixed frame comprising an internal part having a tooth; and a spring presses said internal part to engage said tooth with said slit to produce locking.

20. The flying toy according to claim 13, wherein a fixed ramp is positioned within a space formed by said periphery of said circular plate and said second, movable end, and said second, movable end is capable of sliding on said fixed ramp.

21. The flying toy according to claim 13, wherein said movable part include an interior projection, and said shaft includes a radial projection mounted to cooperate with said interior projection to limit bending of said movable part during operation of said activation mechanism.

22. The flying toy according to claim 18, wherein said fixed frame includes abutments limiting pivoting amplitude of said stop member in each direction.

23. A process for automatic immobilization of wings of a flying toy operating by flapping of the wings, the flying toy including a wing activation mechanism positioned at a front part and including an elastic band providing motive force, and a drive crank; said process comprising applying a stop member of the wing activation mechanism against a circular plate of the drive crank of the wing activation mechanism, which circular plate includes a slit, the stop member not being engageable with the slit when the activation mechanism is moving at a higher torque, and as the elastic band becomes untwisted the stop member engaging the slit to lock the wing activation mechanism and immobilize movement of the wings.

24. The process according to claim 23, wherein torque resulting from unwinding of the elastic band and resistance of the flapping wings cause deformation of a flexible portion of a cylindrical wall of the circular plate from a rest position, and a narrowing of the slit to prevent engagement of a tooth of the stop member in the slit, and providing force by a spring pushing on the stop member to engage the tooth in the slit as the torque decreases and the elastic band approaches complete relaxation.

25. The process according to claim 24, wherein the stop member and the slit are associated with each other so that the stop member engages the slit to lock the wings in a gliding position.

* * * * *